US005131840A

United States Patent [19]

Zettner

[11] Patent Number: 5,131,840

[45] Date of Patent: Jul. 21, 1992

[54] COMBUSTION DEVICE FOR COMBUSTION OF TWO FLUID COMPONENTS

[76] Inventor: Michael L. Zettner, Neufriedenheim 9, 8830 Treuchtlingen, Fed. Rep. of Germany

[21] Appl. No.: 466,395

[22] PCT Filed: Oct. 25, 1988

[86] PCT No.: PCT/EP88/00953

§ 371 Date: Apr. 26, 1990

§ 102(e) Date: Apr. 26, 1990

[87] PCT Pub. No.: WO89/04439

PCT Pub. Date: May 18, 1989

[30] Foreign Application Priority Data

Nov. 3, 1987 [DE] Fed. Rep. of Germany ..... 3737247

[51] Int. Cl.[5] ..... F23A 14/62; F23A 14/10

[52] U.S. Cl. ..... 431/353; 431/354; 431/355; 431/158; 431/160

[58] Field of Search ..... 431/10, 12, 158, 351, 431/353, 354, 355, 160, 189, 187; 239/128

[56] References Cited

U.S. PATENT DOCUMENTS

| | | | |
|---|---|---|---|
| 1,069,243 | 8/1913 | Fogler | 431/354 X |
| 1,802,137 | 4/1931 | Cremer et al. | 431/160 |
| 1,838,903 | 12/1931 | Buschow | 431/160 |
| 1,994,547 | 3/1935 | Urquhart | 431/354 |
| 2,450,790 | 10/1948 | Greaves | 431/355 X |
| 3,733,165 | 5/1973 | Nakagawa et al. | 431/10 |

FOREIGN PATENT DOCUMENTS

| | | | |
|---|---|---|---|
| 122708 | 11/1946 | Australia | 431/355 |

*Primary Examiner*—Carl D. Price

*Attorney, Agent, or Firm*—Sughrue, Mion, Zinn Macpeak & Seas

[57] ABSTRACT

A burner device for combustion of a combustible mixture of two flowable components consists of a chamber housing, first feed means for the first component, second feed means for the second component and an outlet opening for the combustion gases. Serving as feed means for the first component is an injector pipe, which has a rearward axial bore at its end oriented towards the outlet opening, a narrower forward axial bore at its other end, a constriction between the two bores. The feed means for the second component consists of at least one inclined channel which extends radially and obliquely relative to the injector axis with the apex of the angle $\alpha$ pointing in direction of the rearward axial bore and extending from the interior of the chamber housing into the constriction, or shortly before the constriction, along sides of the forward axial bore so that a part of the second component entering into the chamber housing flows through the inclined channels to the constriction, intermixes there with the first component entering through the forward axial bore, combusts in the rearward axial bore and flows therefrom into the chamber housing.

7 Claims, 4 Drawing Sheets

COMBUSTION DEVICE FOR COMBUSTION OF TWO FLUID COMPONENTS

FIELD OF THE INVENTION

The present invention relates to a burner device for combustion of a combustible mixture consisting of two fluid components.

DESCRIPTION OF THE RELATED ART

In combustion processes of the kind taking place in modern internal combustion engines, a distinction is made between closed and open systems. In a closed system, there is a closed combustion space in which fuel and an oxidizer are mixed together, combusted and then perform mechanical work or generate heat through expansion of the combustion gases.

In an open system, fuel and an oxidizer are combusted in a combustion chamber and the combustion gases issue as a jet from an opening in the combustion chamber. The gas jet can be employed as, for example, the drive medium in aircraft, space vehicles or turbines, as well as other purposes, such as heating. In open systems, a high flow speed of the fuel and oxidizer into the combustion chamber has a disadvantageous effect on ignition. The range of the mixture ratio of propellant and oxidizer in which ignition is possible (ignitability range) becomes smaller with increase in flow speed or combustion chamber pressure.

If the fuel and oxidizer mixture ratio necessary for ignition can not be adhered to, so-called flame-outs occur. The flame front tears off and unburnt media flow through the combustion chamber. In the case of propellants which are extremely inhomogeneous, adhering to this range requires costly auxiliary systems. In the case of propellants which burn very rapidly or even detonate, for example hydrogen, the ignitability range becomes extremely small at higher flow speeds and, in dependence thereon, higher combustion chamber pressures. The thermal influences can lead to the ignitability range deviating to such an extent that flame-outs occur.

In the case of thermally favorable combustions of lean mixtures, there is again a very small ignitability range at higher flow speeds of the media to be burnt and, in dependence thereon, high combustion chamber pressures. Here, too, the risk of flame-outs is very high. In order to achieve high thermal efficiencies, a costly construction with a preliminary combustion chamber and valves must be used in open systems.

A different solution for elimination of the ignition problem would be to enrich the mixture well beyond the stoichiometric equilibrium. However, this would lead to worse thermal efficiencies. A catalytic remedy would be very costly and, possibly, also harmful to the environment.

In U.S. Pat. No. 3,733,165, there is described a combustion device for combustion of a combustible mixture of two fluid components of which at least one is fed at a high pressure or high speed, comprising a housing with a chamber, means for feeding the first and second component and for mixing thereof, an outlet opening for combustion gases, an injector pipe which projects into the chamber housing in direction of the outlet opening thereof and which has an axial bore for the feed of the first component, a construction in the axial bore, and at least one inclined channel extending radially and at an inclination relation to the injector axis from the interior of the chamber housing and with its inner end oriented in direction of the axial bore, through which channel flows a part of the second component entering into the chamber housing and mixes in the first axial bore with the first component. This combustion device does not address problems which arise from a less than stoichiometric combustion, i.e. from the combustion of a lean mixture, in particular at high flow speeds.

SUMMARY OF THE INVENTION

The invention therefore has the object of creating a burner device for combustion of a fluid fuel with a fluid oxidiser, by which, in particular, ignition problems arising in the case of lean mixture are avoided.

This object is met by the invention in that the chamber housing is longer than the part of the injector pipe that projects into the chamber housing, the injector pipe has a larger rearward axial bore at its end oriented towards the outlet opening, a narrower forward axial bore at its end remote from the outlet opening, the constriction between the two bores and the inclined channel of variable total cross-section and extending, with its inner end oriented in direction of the rearward axial bore, into the constriction or into the forward axial bore in the region of the constriction, wherein this mixture, as rich mixture with high ignitability is for the greater part combusted in the rearward axial bore, thus heats the wall in the region of the rearward axial bore, flows therefrom into the rest of the chamber housing, intermixes therein with the remaining part of the second component and combusts in entirety.

The injector tube preferably consists of a base part with the rear axial bore and a co-axial injector needle which is movable in longitudinal direction in the base part and is provided with the forward axial bore, wherein the total cross-section of the inclined channel is variable through movement of the injector needle in axial direction.

In a highly energy-rich combustion in the injector tube, it can, in modification of the invention, be necessary to provide the injector tube with cooling ribs on its outer side. Consequently, a higher heat delivery takes place to the second component, for example the oxidiser, flowing externally along the injector tube.

In the case of forwardly open chamber housings, for example as in the case of ramjet engines, the injector tube must, in further modification of the invention, be formed to be angled or arcuately curved.

In one preferred embodiment of the burner device, this consists of a cylindrical chamber housing with a head part, wherein the head part has a central bore, about which a plurality of nozzles are arranged as supply devices for the second component, for the reception of the injector tube.

In a special form of the invention, the injector tube consists of a catalytic material or is provided with a catalytic material.

BRIEF DESCRIPTION OF THE DRAWINGS

Embodiments of the invention are given in perspective, partly-sectional illustration in the drawings, wherein.

DETAILED DESCRIPTION OF THE PREFERRED EMBODIMENTS

Figure 1:
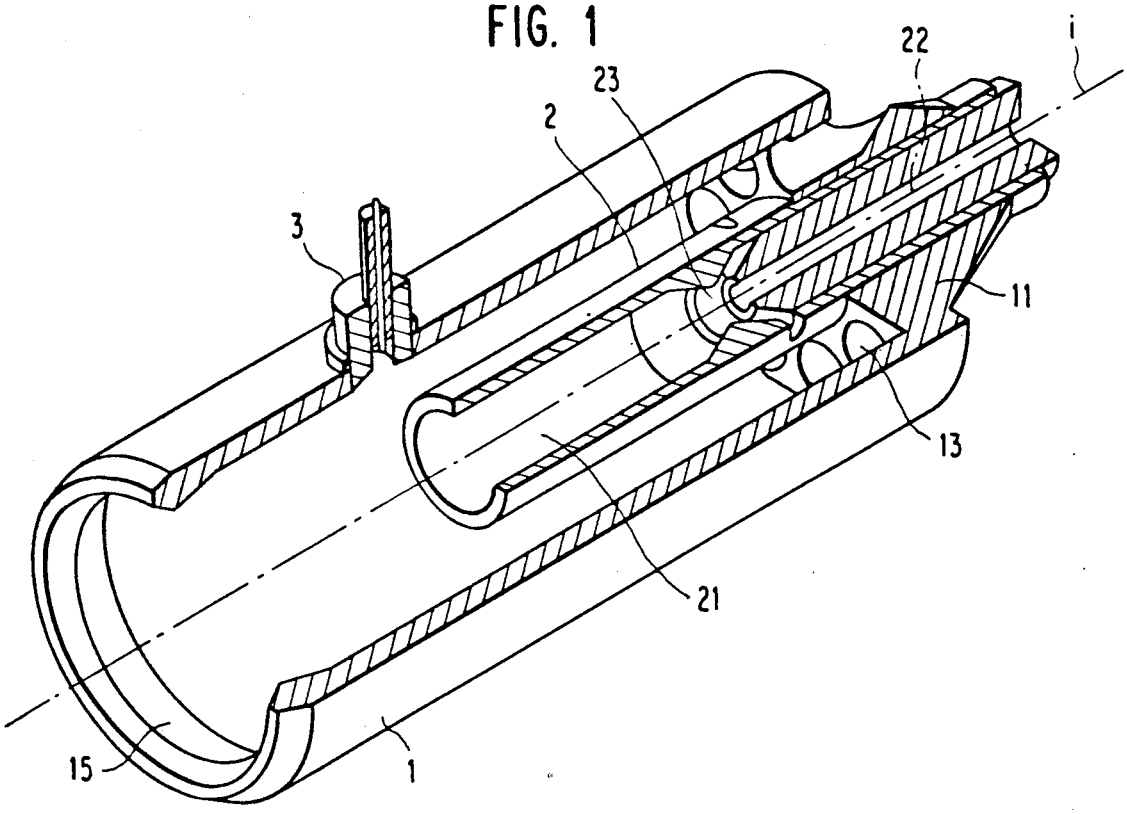
FIG. 1 is a burner device of the preferred embodiment with a chamber housing and an injector tube.
Figure 2:
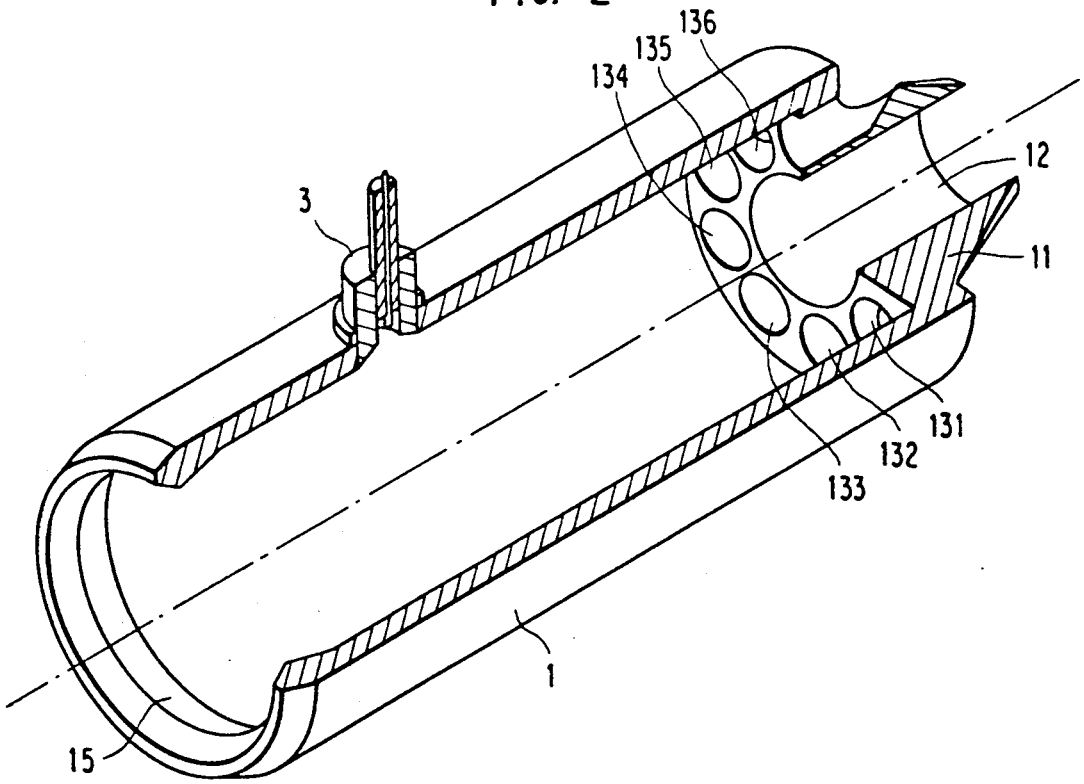
FIG. 2 is the burner device according to FIG. 1, without injector tube.

A perspective, partially sectioned illustration of a burner device with a chamber housing 1 and an injector tube 2 is shown in FIG. 1. The chamber housing 1 serves for combustion of a fluid fuel with a fluid oxidiser at high combustion chamber pressure or high entry flow speed. The term "fluid" is understood to include all liquids gases or emulsions, also mixtures of liquids or gases with solid substance particles, but which have fluid properties. Cylindrical chamber housing 1 with a disc-shaped head part 11 is shown as an embodiment, by way of example, in FIGS. 1 and 2, wherein the head part 11 is provided with a central bore 12 (FIG. 2), about which a plurality of nozzles 131–136 are arranged as feed means for the second component of a combustible mixture, for the reception of the injector tube 2. Nozzles 131 to 136, for example, are visible in FIG. 2. However the number or position of the nozzles 131–136 is not of significance to the invention. The combustion gases issue from the chamber housing 1 as a jet through the outlet opening 15.

Figure 3:
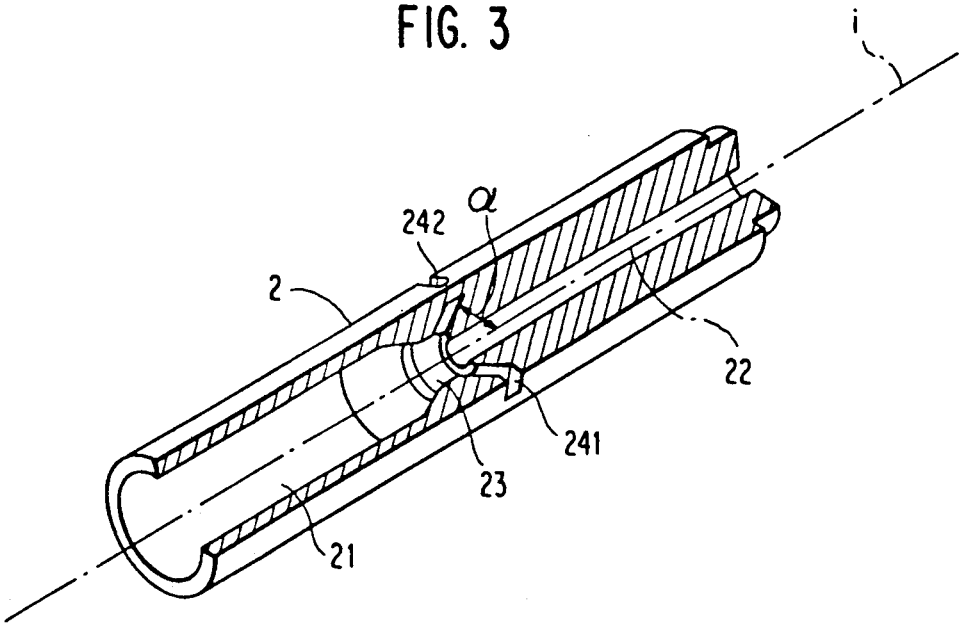
FIG. 3 is a non-adjustable injector tube.

The injector tube 2 shown in FIG. 3 serves as feed means for the first component of the combustible mixture. It has a rearward axial bore 21 at its rearward end oriented towards the outlet opening 15, a narrower forward axial bore 22 at its end remote from the outlet opening 15, and a constriction 23 between the two bores 21 and 22. In addition a plurality of inlcined channels 241 and 242 extend radially and obliquely relative to the injector axis i—with the apex of the angle $\alpha$ pointing in direction of the forward axial bore 21—from the chamber interior to the constriction 23 or on sides of the rearward axial bore 22 shortly ahead of the constriction 23. A part of the second component entering the chamber housing 1 flows through the inclined channels 241 and 242 into the constriction 23 or shortly ahead the constriction 23, intermixes therein with the first component entering through the rearward axial bore 22, and combusts in the rearward axial bore 21. Due to the fact that the inclined channels 241 and 242 from an acute angle $\alpha$ with the injector axis i, the second component flowing through the inclined channels 241 and 242 to the constrictions 23 exerts a suction affect on the first component entering by way of the forward axial bore 22. The cross-sectional area of all inclined channels 241 and 242 together with the cross-sectional area of the forward axial bore 22 is greater than the cross-sectional area of the constriction 23. The cross-sectional area of all of the inclined channels 241 and 242 is therefore not added to the cross-sectional area of the constriction 23 when the inclined channels 241 and 242 open wholly or partially into the constriction 23.

Ignition of the combustible mixture is effected in the chamber housing 1 by way of an ignition probe 3. Therefore, the two components of the combustible mixture are conveyed at only low pressure or flow speed into the chamber housing 1 during the ignition phase of the burner device. After ignition, the flame blows back as far as the constriction 23 between the two axial channels 21 and 22, but not beyond the constriction. The two components of the combustible mixture initially intermix at the constriction 23, as there is no ignitable mixture in the forward axial bore 22 ahead of the constriction 23. In the case of an open burner device, for example with a combustible of 4 bars in the chamber housing 1, air is supplied as second component at 5 to 6 bars to the chamber housing 1 through the nozzles 13 and the fuel as first component is supplied to the injector tube 2 at a pressure of merely 0.6 bars. A back pressure or "stuttering" of the combustion does not occur even with these large pressure differences.

Figure 4:
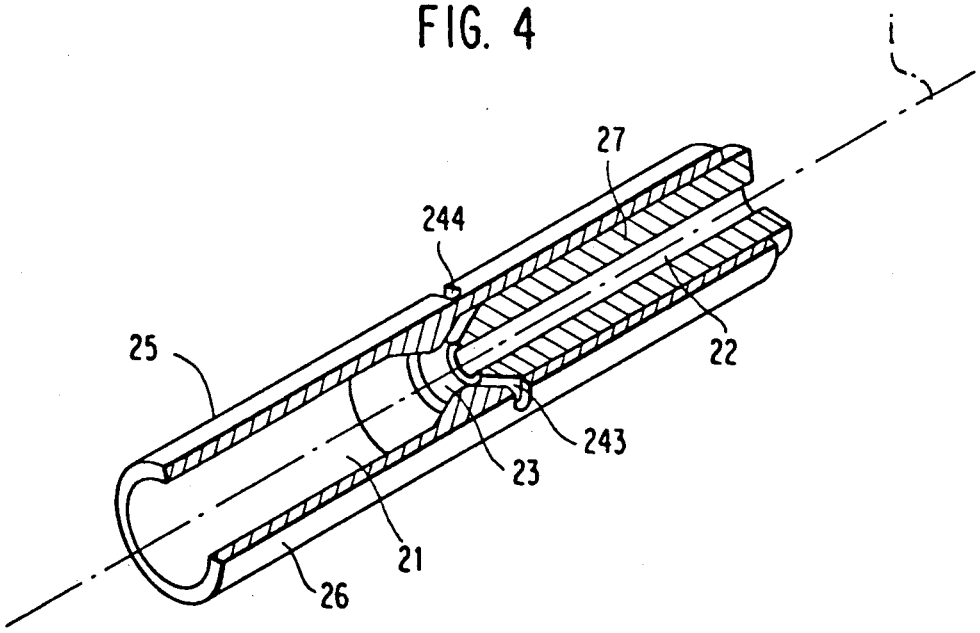
FIG. 4 is an adjustable injector tube.
Figure 4A:
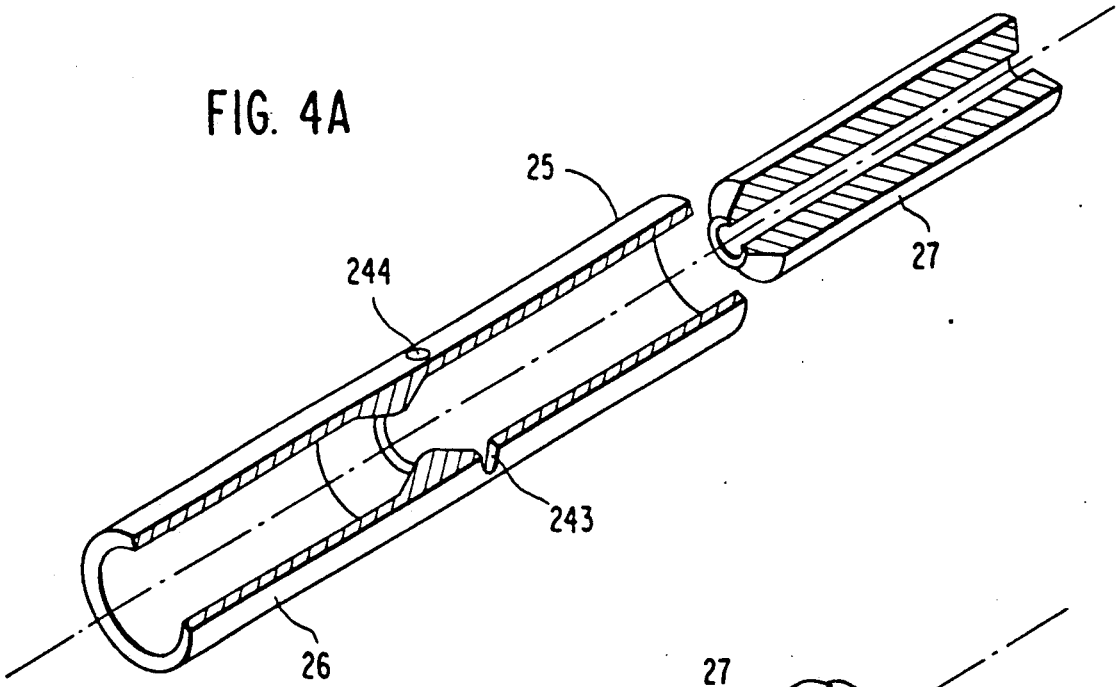
FIG. 4A is an exploded illustration of the adjustable injector tube according to FIG. 4.
Figure 4B:
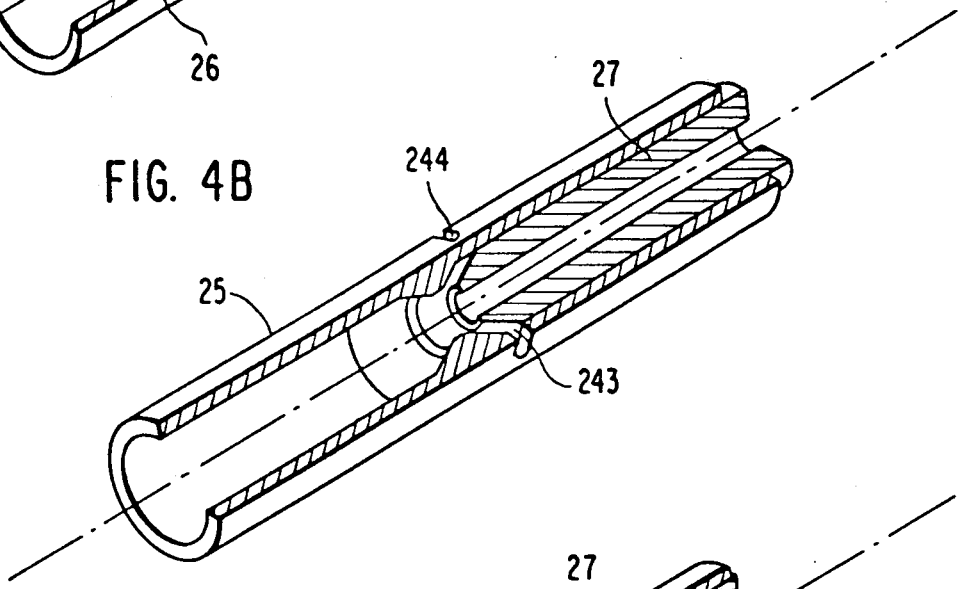
FIG. 4B is the adjustable injector tube according to FIG. 4 with open inclined bores.
Figure 4C:
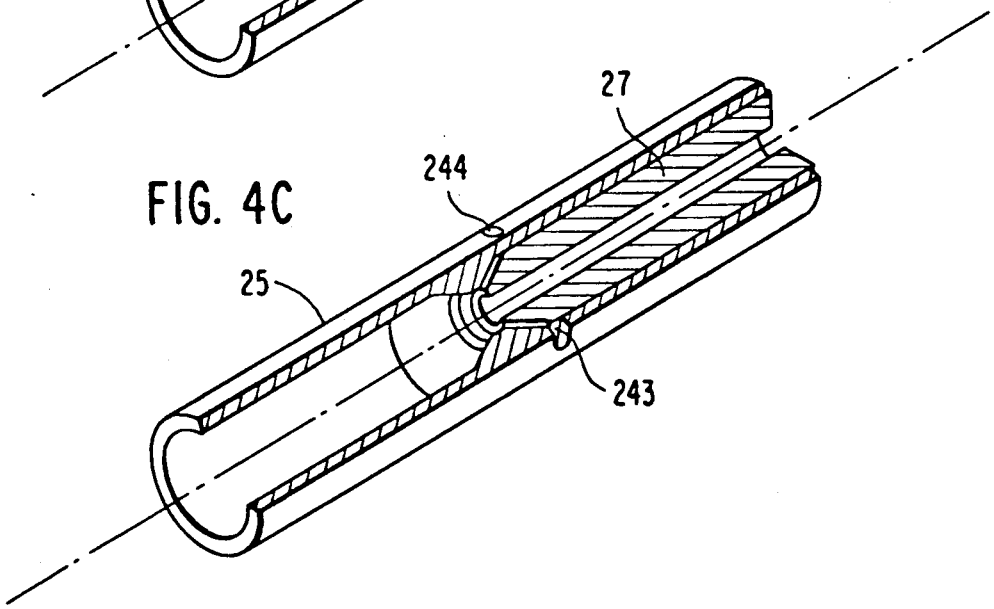
FIG. 4C is the adjustable injector tube according to FIG. 4 with nearly closed inclined bores.

For technical and economic reasons, the combustion behavior of the burner device is of particular interest in the case of an excess of the second component, for example air, or a lean mixture. The use of the injector tube 2 has the effect that there is no change in the combustion behavior in respect to the ignitability of the mixture when there is a change in pressure and flow speed in the chamber housing 1, but only when there is a change in the injector tube setting as illustrated in FIGS. 4B and 4C. Thus, combustion in the injector tube 2 can be influenced by enlargement or reduction of the inclined channels 241 and 242. The above-described decoupling of the combustion behavior of the burner device from the leanness of the mixture does not occur when the first component is supplied to the chamber housing 1 merely through a hollow needle, with or without nozzle, projecting into the chamber housing 1. In that case, such lean mixtures may arise as to be below the level of ignitability.

The rearward axial bore contains a very rich mixture, as the greater part of the second component flows by externally of the injector tube 2 and only the lesser part of the second component, which enters into the injector tube 2 through the inclined channels 241 and 242, reacts with the first component in the injector tube 2. The part of the second component which flows externally along the injector tube 2 acts as an envelope flow and thereby prevents the heat of the injector tube 2 from being lost to the combustion system. This envelope current reduces the heat transfer from the hot core flow, which issues from the injector tube 2, to the outer walls of the chamber housing 1, as only the much lower temperature gradient between the envelope flow and outer walls is critical for heat losses. Consequently, more energy remains in the combustion gases and the combustion altogether has improved efficiency. During combustion in the rearward axial bore 21 of the injector tube 2, those parts of the second component which pass through the inclined channels 241, 242, and 243 into the injector tube 2, react with the first component entering by way of the forward axial bore 22. However during this combustion, unburnt residues can, for various reasons, pass from the injector tube 2 into the chamber housing 1. At the boundary zones of the core flow relative to the surrounding envelope flow, there may then be reactions between the second component, which is present in the envelope current and has not passed through the inclined channels 241 to 244 into the injector tube 2, and the unburnt residues of the first component, which has passed through the injector tube 2 into the chamber housing 1. Unburnt residues of the first component can occur in the following cases:

In the case of inhomogeneity of either or both components. In this case the combustion in the rearward axial bore 21 changes in proportion to change in the composition of either or both of the components. With inhomogeneous fuels, the volume ratio of the components is adjusted so that, even in the case of the weakest possible energy content of the respective components, a mixture securely disposed in the easily ignitable range can combust in the rearwars axial bore 21. On the other hand this means that in the case of the highest possible energy content of the first component, this cannot react completely with the second component, which passes into the injector tube 2 by way of the inclined channels 241 to 244, in the rearward axial bore 21 of the injector tube 2. In the second case, unburnt residues of the first component can also arise due to the fact that the pressures, or the flow speeds and in consequence thereof the pressures, so change that the energy density of the first component changes as a further consequence. In the case of fluctuations in the flow speed or in the pressures at which the components are fed, unburnt residues can occur in the reaction in the rearward axial bore 21 of the injector tube 2. Equally unburnt residues can occur when the reaction speed of the combustion in the rearward axial bore 21 of the injector tube 2 is so small that the time in which the components flow through the rearward axial bore 21 is not sufficient for a complete reaction. This would be conceivable for example, in the case of slow burning emulsions. The structure of the injector tube 2, in particular the length of the rearward axial bore 21, has a substantial influence on the final combustion in such cases.

When departing the rearward axial bore 21 of the injector tube 2, the unburnt residues of the first component have such a high temperature that they immediately react with the second component in the envelope current.

If either or both fuel components are very inhomogeneous, it is necessary to be able to set the mixture ratio of the two components in the injector tube 25 to an optimum. For this purpose, the injector tube 25 shown in FIGS. 4 and 4A consists of a base part 26 with the rearward axial bore 21 and a co-axial injector needle 27, displaceable in longitudinal direction on the base part 26, with the forward axial bore 22. The total cross-section of the inclined channels 243 and 244 is variable by axial displacement of the injector needle 27 in the base part 26.

Consequently it is possible to vary the mixture ratio of the two components as desired during combustion in the rearward axial bore 21. FIG. 4A shows an exploded view of the base part 26 and injector needle 27. The execution of a defined movement of the injector needle 27 in the base part 26 can be effected by way of, for example, a thread, not shown in the drawings, between the base part 26 and injector needle 27.

The injector tube 25 with two extreme settings of the injector needle 27 is shown in FIGS. 4B and 4C; the inclined channels 243 an 244 are opened fully in FIG. 4B and almost closed in FIG. 4C. During combustion of different components in the same injector tube 25, only the injector needle 27 needs to be varied in predetermined manner or reset on change from one fuel to another.

Only two inclined channels 241 and 242 or 243 and 244 are shown in the drawings. However it is self-evident that the number of the inclined channels is not restricted to this number, but that as many inclined channels can be present as are needed for the supply of an adequate proportion of the second component or for a spatially uniform distribution.

Figure 5:
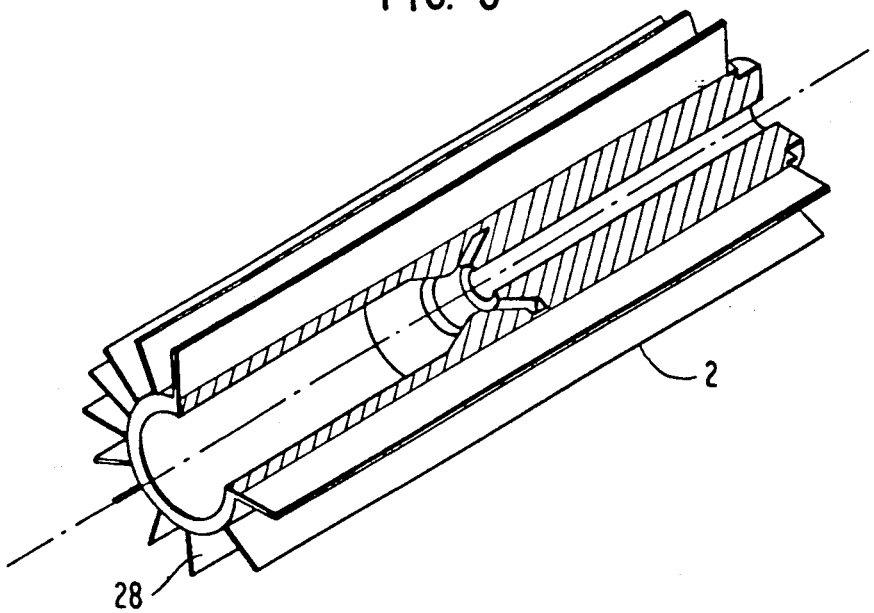
FIG. 5 is an injector tube with cooling ribs.

An injector tube 2, which has cooling ribs 28 on its exterior, is shown in FIG. 5. The number and geometry if the cooling ribs 28 must be determined from case to case.

Figure 6:
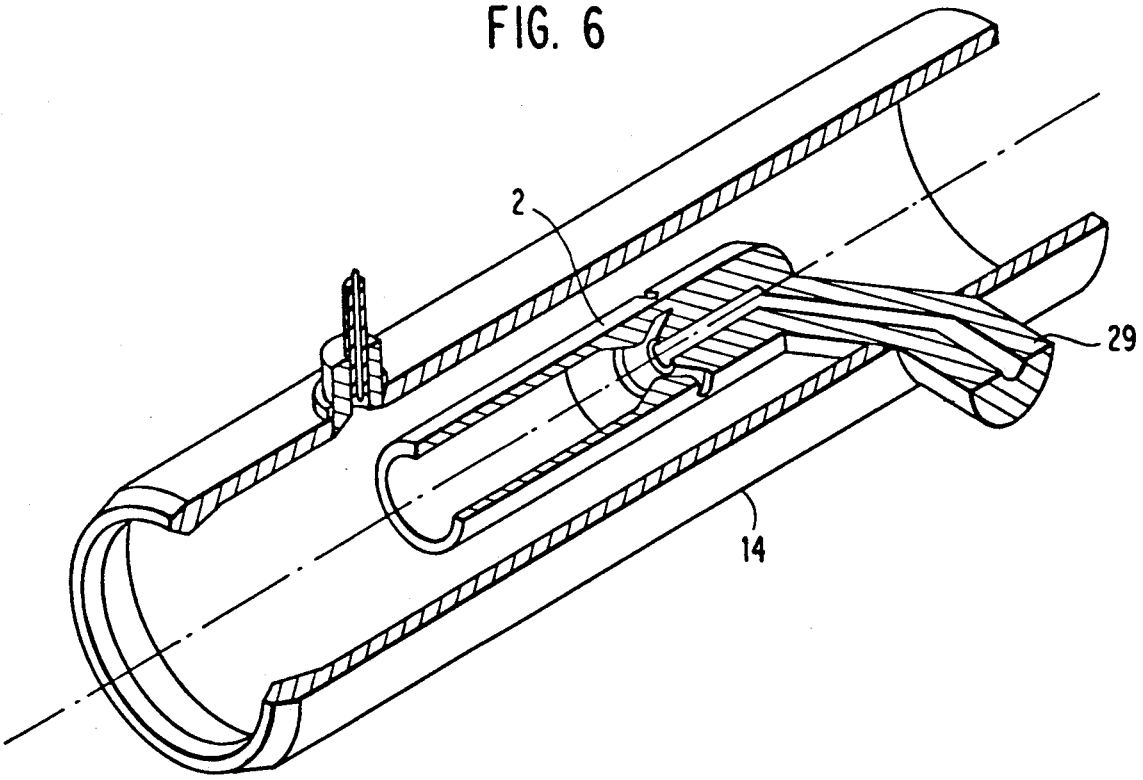
FIG. 6 is a combustion chamber housing with an angled injector tube.

Finally, FIG. 6 shows a forwardly open chamber housing 14 in which the injector tube 2 is mounted by an angled projection 29. The first component, too, is supplied through the projection 29. The projection 29 can be curved like a section of a circular arc so that an injector tube 25 with inclined channels 243 and 244 of variable cross-section is usable.

For improvement in the combustion, the injector tube 2 can consist of a catalytic material or be provided with a catalytic material.

What is claimed is:

1. A burner for combustion of a combustible mixture of two fluid components of which at least one of the components is supplied to the burner at high pressure or high speed, comprising:

a housing defining a chamber therein, said chamber having first and second ends, said chamber having an exhaust opening for gases produced by combustion of the mixture within said housing at said second end; and an injector tube for feeding a first component to said housing, said injector tube extending in said housing from said first end towards said second end and comprising (a) an outlet axial bore portion at a position thereof closest to said second end, (b) an inlet axial bore portion, proximate said first end, having a smaller cross-sectional area than said outlet axial bore portion, (c) a flow constricting portion disposed between said outlet bore portion and said inlet bore portion, (d) at least one inclined transfer passage which communicates at one end thereof with said chamber and at the other end thereof with the interior of said injector tube in a region thereof formed by said flow constricting portion and by part of said inlet axial bore portion adjacent to said flow constricting portion, said transfer passage extends radially and obliquely relative to an axial direction of said injector tube such that said one end is closer to said exhaust opening than said other end, and (e) means for varying the effective cross-section of said transfer passage, said housing being longer than said injector tube such that said outlet axial bore portion is disposed in said chamber at predetermined distance from said exhaust opening, and said transfer passage transfers a portion of a second component from said chamber to one of said flow constricting portion and said inlet axial bore portion for mixture with said first component so as to effect a partial combustion of said first and second components in said outlet axial bore portion and so as to simultaneously heat a wall of said outlet axial bore portion said spacing of said outlet axial bore portion from said exhaust opening being selected so as to allow the partially combusted said first and second components to be discharged from said outlet axial bore portion for mixture and complete combustion with a remaining portion of said second component in said chamber.

2. A burner, as claimed in claim 1, wherein said injector tube comprises an outer tubular member defining said outlet axial bore portion and an inner tubular member which extends coaxially in said outer tubular member so as to define said inlet bore portion, said inner tubular member being axially movable relative to said outer tubular member so as to vary said effective cross-section of said transfer passage.

3. A burner, as claimed in claim 1, wherein said injector tube is provided on its external circumference with a plurality of cooling fans.

4. A burner, as claimed in claim 1, wherein said injector tube has an inlet end portion which extends at an angle relative to remaining portions of said injector tube.

5. A burner, as claimed in claim 1, wherein said chamber is cylindrical and said housing has a wall which is disposed so as to close said chamber at said first end, said wall being provided with a central bore and with a plurality of nozzle bores arranged around said central bore, said injector tube being mounted in said central bore and said nozzle bores being disposed for feeding said second component into said housing.

6. A burner, as claimed in claim 1, wherein said injector tube is constructed of catalytic material.

7. A burner, as claimed in claim 1, wherein said injector is provided with a coating of a catalytic material thereon.

* * * * *